United States Patent [19]

Green

[11] 4,089,528

[45] May 16, 1978

[54] RAFT WITH REMOVABLE WEIGHTED MEMBERS THAT PROVIDE BUOYANCY

[75] Inventor: William J. Green, Salt Lake City, Utah

[73] Assignee: Stanley O. Vogen, Salt Lake City, Utah

[21] Appl. No.: 752,538

[22] Filed: Dec. 20, 1976

[51] Int. Cl.[2] ..... A63B 11/00

[52] U.S. Cl. ..... 272/122; 9/11 R

[58] Field of Search ..... 272/117, 122, 123, 116, 272/DIG. 1, DIG. 5; 46/91, 93, 96; 9/11; 220/375, 307, 339; 215/306; 128/350 R

[56] References Cited

U.S. PATENT DOCUMENTS

| | | | |
|---|---|---|---|
| 808,706 | 1/1906 | Villedrouin | 272/122 |
| 984,721 | 2/1911 | Titus | 272/122 |
| 1,019,584 | 3/1912 | Balston | 272/122 |
| 2,676,802 | 4/1954 | O'Brien | 272/123 |
| 3,106,311 | 10/1963 | Fairchild | 220/307 |

FOREIGN PATENT DOCUMENTS

| | | | |
|---|---|---|---|
| 966,866 | 4/1975 | Canada | 272/122 |
| 999,033 | 7/1965 | United Kingdom | 272/123 |
| 28,047 of | 12/1912 | United Kingdom | 272/122 |

*Primary Examiner*—William R. Browne
*Attorney, Agent, or Firm*—Warren F. B. Lindsley

[57] ABSTRACT

A weight lifting device or apparatus specially adapted for use in water, such as pools, or at the beach, the weight of which may be varied to fit the needs of the user. Special filling and draining arrangement facilitates adding or removing water equally and simultaneously from both ends of the device to insure balance between the two ends.

7 Claims, 8 Drawing Figures

RAFT WITH REMOVABLE WEIGHTED MEMBERS THAT PROVIDE BUOYANCY

BACKGROUND OF THE INVENTION

This invention relates to weight lifting devices and more particularly to weight lifting devices for use in the water at the beach or in the swimming pool.

In the warmer parts of the country, swimming pools and beaches afford an excellent opportunity for recreation and excercise during that part of the year when it is often so hot as to discourage or render undesirable most other forms or rigorous exercise. Furhermore, the pool or other body of water provides for the bather a climate in which he can practice sports of various types while his body is cooled by the water or by the evaporation thereof from his skin.

Thus, for example, and getting to the point of interest, while it may often be too hot in the Arizona summer to practice weight lifting under ordinary circumstances, on can quite comfortably engage in this form of exercise in the environment of the family swimming pool. There is also another benefit to be realized through the practice of weight lifting in swimming pools. Utilizing the buoyancy of the water during the first part of the lifting stroke, an athlete may spare his back while he is bent over during the first part of the lifting stroke. Only after he has straightened his back does he feel the full weight of the device as it leaves the water. It thus becomes possible to employ weight lifting as a means of building the arms and shoulders while protecting the back against undesired stress.

Unfortunately, however, there has not been available in the past a weight-lifting device which is entirely suitable for use in such an environment. The usual replaceable weights are particularly awkward to add or remove while standing in a pool of water. Furthermore, there is no convenient place for the weights to be stored while they are removed. The various types of hollow weights are intended to be filled with fluids for weight adjustment are also less than ideal for this environment because their design has not contemplated their use in water. Typically, they are intended to be filled, one end at a time, using a funnel and a dipper. This equipment along with the stopper is difficult to handle in the pool and it is likely that some part of it will be lost during the filling operation. Further complicating such a filling operation is the difficulty of insuring that the weights at both ends of the bar are filled evenly so as to achieve the necessary balance of the device. Finally, the typically metal or at least partially metal constructions are, for the most part, not suitable for use in the corrosive environment of salt water or in the chlorinated water of the swimming pool.

It is apparent, therefore, that a need exists for an adjustable weight-lifting device which is designed specifically for use in water.

FIELD OF THE INVENTION

This invention is directed to weight lifting devices for use in water, the weight of which may be varied to fit the needs of the user by utilizing the water in which he is exercising.

DESCRIPTION OF THE PRIOR ART

Heretofore, weight-lifting devices such as bars have been varied by adding or subtracting weights from each end of the bar. This is particularly difficult when used in the water, such as at the beach or in the swimming pool. Further, the known bars are difficult to transport and use because of their weight or the accessory weights to be used therewith. Some prior art devices utilize water or other liquids as filling materials, but no provision is made for filling by submersion as in the case of the present invention.

SUMMARY OF THE INVENTION

In accordance with the invention claimed, an improved weight-lifting bar is provided for use in the water, the weight of which may be varied to fit the desires of the user by the use of the water in which he is exercising or bathing.

It is, therefore, one object of this invention to provide an improved weight-lifting device.

Another object of this invention is to provide an improved weight-lifting bar, the weight of which may be varied to fit the desires of the user.

A further object of this invention is to provide a weight-lifting bar having containers fixedly attached at the ends of the bar which may be selectively filled or drained of water.

A still further object of this invention is to provide enclosed cylindrical containers axially mounted along the axis of a weight-lifting bar one at each end thereof so that a sight gauge thereon will indicate the amount of water placed therein and accordingly the weight of the bar.

A still further object of this invention is to provide hollow containers axially mounted one on each end of a weight-lifting bar having valves or ports located in their outer surfaces for admitting or discharging water from their interiors to vary the weight of the bar.

A still further object of this invention is to provide such a weight lifting bar in a form which permits the addition or removal of water from the end containers without the use of funnels, dipping means or other apparatus.

A still further object of this invention is to provide such a weight-lifting bar which is specially adapted for adding or removing water from both containers simultaneously, the water being admitted from the pool by partial submersion of the containers and water being drained into the pool while the containers are partially supported by the buoyancy of the water of the pool.

A still further object of this invention is to provide such a weight-lifting bar wherein the fill hole orientations of the two containers are controlled relative to each other so as to guarantee the balanced filling or draining of the two ends during such a simultaneous filling or draining procedure, thereby to insure a proper weight balance between the two ends.

A still further object of this invention is to provide in such a weight-lifting bar convenient and inexpensive filling hole covers which are captured in holes adjacent the filling holes to prevent their being dropped or lost.

Yet another object of this invention is to provide a raft structure which may be supported by a pair of the weight-lifting bars of the invention.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
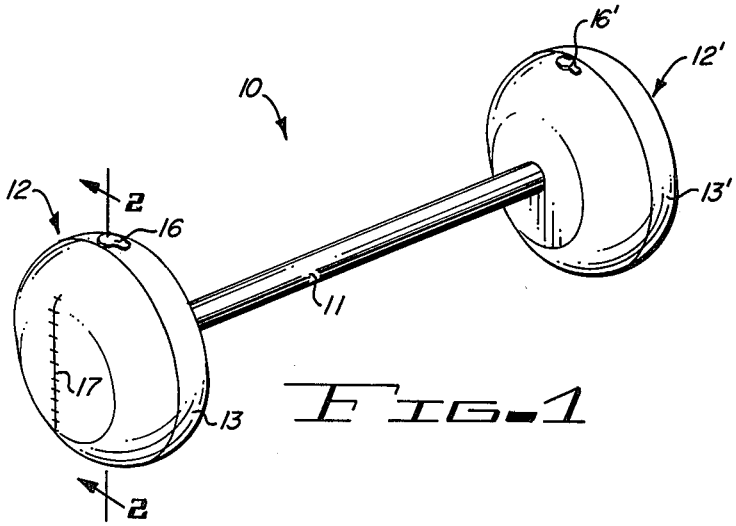
FIG. 1 is a perspective view of a weight-lifting apparatus of the present invention.
Figure 2:
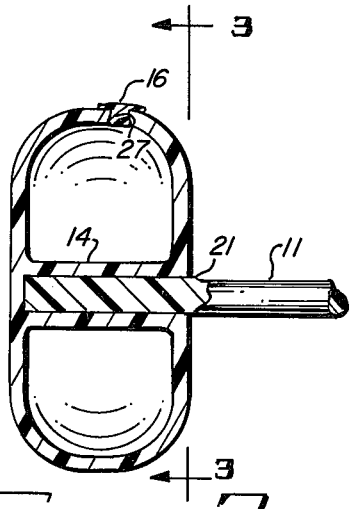
FIG. 2 is a cross-sectional view of FIG. 1 taken along the line 2—2.

Referring more particularly to the drawing by characters of reference, FIGS. 1–4 disclose a weight supporting or lifting apparatus 10 of the type used in weight lifting comprising a weight-lifting shaft or bar 11 adapted to support at each end identical hollow housings, containers or canisters 12, 12'. The housings comprise identical closed ended cylinders or other similar suitable hollow configurations 13, 13' having bearings 14, 14' extending axially therethrough for receiving and supporting an end of bar 11, as shown in FIG. 2. The bearings form the canisters into doughnut configurations. The outer surface of canisters 12, 12' are provided with valve mechanisms 16, 16'. Valve mechanisms 16, 16' provide inlet and outlet ports for water, thereby providing the medium for increasing and decreasing the weight at each end of bar 11.

Although the closed ended watertight canisters 12, 12' may be formed of any type of material such as metal or plastic, it is preferable to form them out of a transparent plastic material so that the amount of water in the structures may be noted and controlled.

To aid in judging the amount of water in the canisters and in turn the weight at each end of the lifting apparatus, a suitable scale 17 may be marked on the outside surface of one or both ends of one or both of the structures of the lifting apparatus.

Since the lifting apparatus is intended to be used in water, bar 11 may be metal covered with a suitable coating to protect it from the rusting effects of the water. This coating may be of a non-rusting metal such as chrome or of a suitable plastic material. Of course, if the bar is of a non-corrosive material, it need not be covered.

In the construction of FIGS. 1–5 the hollow cylindrical bearing 14 is closed at the outer end and it is dimensioned to receive the end of the bar 11 in an interference fit. Further, in accordance with a stated object of the invention, the fit of bar 11 inside bearing 14 is keyed to control the rotational orientation of the canisters 12, 12' relative to bar 11 and hence relative to each other. This keying is achieved by means of a longitudinal ridge 21 provided at each end of the bar and on the same side of the bar at both ends. A mating groove 22 is provided on the inside of bearing 14, groove 22 also running longitudinally of the bearing and dimensioned to receive ridge 21. It is thus necessary to align groove 22 with ridge 21 as bar 11 is installed in bearing 14. Once installed, the rotation of bar 11 within bearing 14 is prevented by the keying action of ridge 21 and groove 22. In this manner the same relative rotational positions of canisters 12 are determined and maintained so that the two valve mechanisms are rotationally aligned.

The purpose served by such alignment is to permit the simultaneous and balanced filling of the two containers or canisters 12 and 12' by submersion in the water of the pool, lake or other body of water. This simultaneous filling is accomplished by first opening the two valves 16 and 16', then partially submerging both containers 12 and 12' to an equal depth and rotating the device 10 until the valves 16 and 16' open at the water's surface. The canisters 12 and 12' are then allowed to fill to the level of the outside water. The amount of water taken in is, of course, determined by the angular rotation and the depth of submersion. It is apparent that the discharge of water may be accomplished in the same manner, i.e. during such partial submersion while controlling the depth and angular rotation to effect the desired amount of discharge.

To further facilitate this convenient means of filling or discharging which, to this point, has required no auxiliary apparatus, the special valves 16, 16' have been designed in a manner which prevents their being lost during the procedure. As shown in FIGS. 1–5, the valves 16, 16' comprise in each case a shaped flat sheet 23 of rubber or flexible plastic from which extend two circular buttons 24 and 25. Button 24, which is the larger of the two buttons, is centered on a large circular end of sheet 23 while the smaller button 25 is centered on the other smaller end of sheet 23. A tab 26 centered on the outer periphery of the large circular end of sheet 23 serves as a lifting means.

Figure 3:
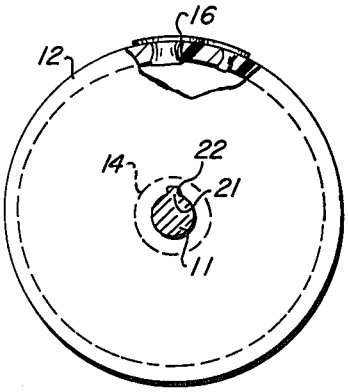
FIG. 3 is a cross-sectional view of FIG. 2 taken along line 3—3.
Figure 4:
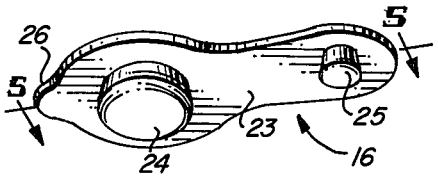
FIG. 4 is a perspective view of a special stopper employed as a part of the device of FIG. 1.
Figure 5:
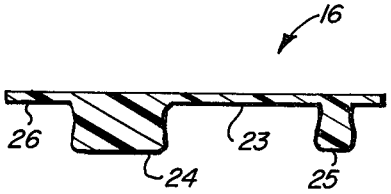
FIG. 5 is a cross-sectional view of FIG. 4 taken along line 5—5.

When the valve 16 is installed in the canister 12, as shown in FIGS. 1–3, the button 24 fits with interference within a circular filling hole 27 located on the outer cylindrical surface of canister 12, its resilience and interference fit effecting the desired watertight seal. The smaller tab 25 fits inside a proportionately smaller aligned hole in the surface of canister 12, again effecting a watertight seal. To open the valve 16, the tab 26 is gripped by the finger and the thumb to withdraw the button 24 from the hole 27. The button 25, however, remains engaged in the smaller hole and the valve 16 is retained thereby during the filling and draining operations so that the user of the device need give no thought to hanging on to it or stowing it during the procedure. Accordingly, there is no danger that the valve 16 will be lost or misplaced and it will be conveniently at hand when the hole 27 is to be closed again.

The stated objects of the invention are thus met in the device 10, which provides all the desired and listed advantages over the prior art.

It will be apparent, of course, that variations of device 10 may be provided in terms of such things as the means for attaching the bar to canisters 12, 12'. Such a variation is shown in FIGS. 6 and 7.

Figure 7:
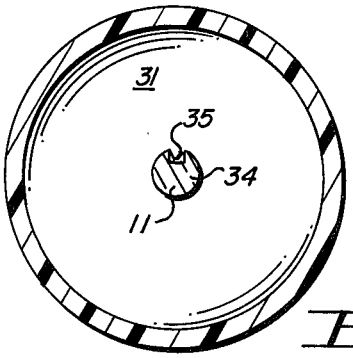
FIG. 7 is a cross-sectional view of FIG. 6 taken along line 7—7.
Figure 6:
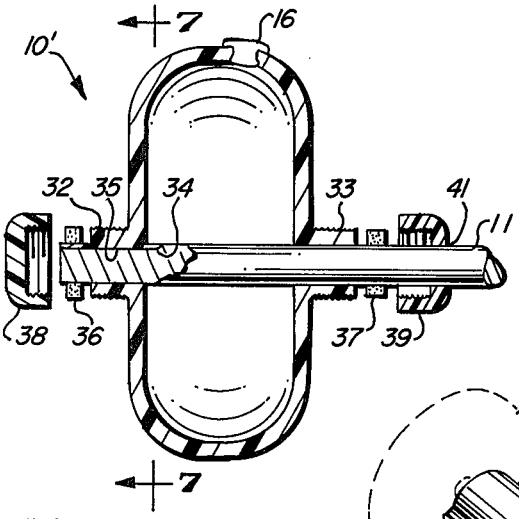
FIG. 6 is a cross-sectional view of a variation of the device of FIG. 1 taken along line 2—2.

DEvice 10' of FIGS. 6 and 7 utilizes a modified canister 31 which has instead of the cylindrical bearing 14 a pair of protruding threaded nipples 32 and 33. Nipple 32 extends outwardly from the center of the outboard surface of canister 31 and nipple 33 extends from the inboard surface of canister 31, both nipples being aligned with the axis of the canister. The open centers of the nipples 32 and 33 communicate with the interior of canister 31, there being no center core such as bearing 14 of FIGS. 1–3 to seal off the interior of the canister.

The inner bore of each of the nipples 32 and 33 is dimensioned for a close fit over the surface of bar 11 when bar 11 is installed as shown in FIG. 6. Again, the rotational position of canister 31 on bar 11 is determined or controlled to effect the alignment of the two canisters at each end of the bar. In this case the position is effected by means of a slot 34 in the end of bar 11 and a mating ridge 35 on the inner bore of nipple 32. The slot 34 need only extend over that part of the length of bar 11 that passes through nipple 32.

Used in conjunction with nipples 32 and 33 to secure canister 31 in position at the end of bar 11 and to effect a watertight seal at the nipples 32 and 33 are two resilient rubber or plastic washter 36 and 37, an end cap 38 and a sleeve fitting 39. The washers 36 and 37 fit over the outer surface of bar 11, one against the end of nipple 32 and the other against the end of nipple 33. Cap 38, which is cylindrical, closed at one end and threaded on its interior surface to mate with the outer threaded surface of nipple 32 slips over the outer cylindrical surface of washer 36 and is turned onto nipple 32 so that washer 36 is confined and compressed between the end of nipple 32 and the flat inner surface of the end closure of cap 38. As washer 36 is compressed axially, it expands radially to form a compression fit against bar 11. Both a mechanical restraint and a watertight seal are thus effected at nipple 32.

The fitting 39 is indentical to cap 38 except that its flat end closure has a circular bore 41 which fits over bar 11. Again, fitting 39 threads over nipple 33, confining and compressing washer 37 against the end of nipple 33 to effect a watertight seal and a mechanical gripping action against the surface of bar 11.

The functionality of the arrangement of FIGS. 6 and 7 match that of the arrangement of FIGS. 1–3 with the added advantage of a more secure coupling of the canisters to the bar as compared with the simple interference fit afforded in the first embodiment.

Figure 8:
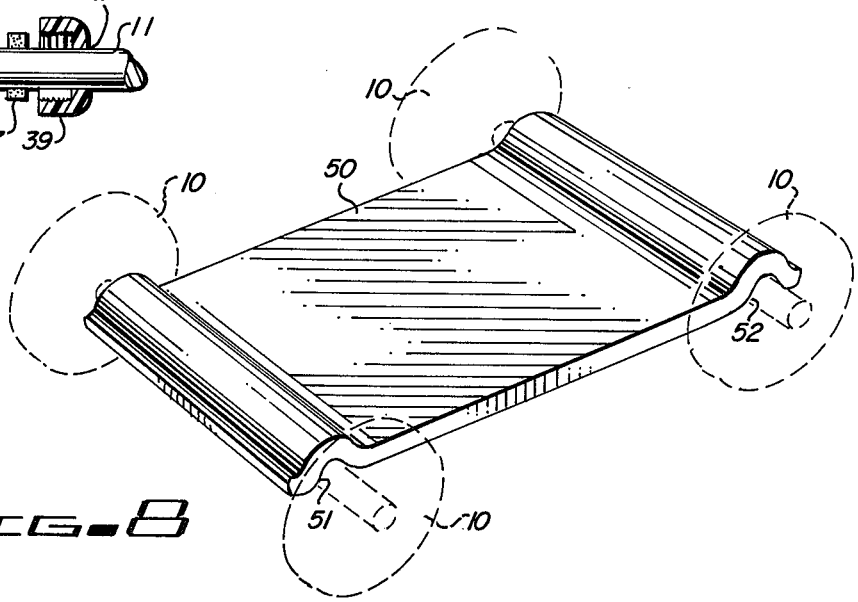
FIG. 8 is a perspective view of a raft platform which is intended to be supported by a pair of the weight-lifting devices of FIGS. 1–7.

A further enhancement of the functionality and utility of device 10 is provided in the form of a raft platform 50 which utilizes a pair of the devices 10 or 10' as floats or buoyant means. Platform 50 is simply a rectangular plate of rigid plastic with two transverse grooves 51 and 52 on the underside which are shaped and appropriately dimensioned to fit over the surface of bar 11 inside the two canisters 12 and 12' or 31 and 31'. One groove 51 is positioned near one end of platform 50 and the other groove 52 is positioned near the other end so that when assembled as shown in FIG. 8 with two of the devices 10, the assembly resembles a four-wheeled wagon. When the water is drained from the canisters 12, 12' or 31, 31' devices 10 or 10' thus effectively serve as floating supports for raft platform 50. The dual utility of the devices 10, 10' as thus afforded by platform is especially useful in the home swimming pool where a raft or float of some sort is commonly employed for sunbathing or resting between periods of swimming.

Although but a few embodiments of the present invention have been illustrated and described, it will be apparent to those skilled in the art that various changes and modifications may be made therein without departing from the spirit of the invention or from the scope of the appended claims.

what is claimed is:

1. A device comprising:

a first shaft, a pair of hollow containers, one mounted at each end of said shaft, each of said containers being provided with an inlet-outlet port and means for opening and closing said port, said containers each comprising a cylindrical bearing means extending axially thereof for receiving an end of said shaft, said cylindrical bearing means and the associated end of said shaft being provided with interlocking means for orienting each of said containers and its port in similar positions on said shaft, said means for opening and closing the port of each container comprising a resilient tab fixedly mounted at one end on said container and provided with a resilient plug at its other end for insertion into said port for sealing it, whereby said port may be opened by lifting the plug end of said tab away from said port and the containers partially or completely filled with water to vary the weight of the containers at each end of the shaft, second shaft and containers in combination identical in structure to the first shaft and containers and spacedly positioned in a parallel coplanar arrangement with the first shaft and its containers, and platform means extending over the shafts of the device and removably interlocking therewith for providing a raft for use on the water.

2. The device set forth in claim 1 wherein:

said bearing means on each of said containers comprises a pair of nipples extending outwardly of the outside periphery of the container on opposite sides thereof along its longitudinal axis, and cap means for fitting over and engaging with each of said nipples of each container, one of said cap means covering the end of said shaft extending into each container, and the other of said cap means being provided with an aperture for receiving therein said shaft and being moveable therealong and over the other of said nipples of each container, said cap means sealing water within the container.

3. The device set forth in claim 2 wherein:

said nipples are threaded along their outer periphery for engaging with matching threads provided within each of said cap means.

4. The device set forth in claim 1 wherein:

at least one of the containers on each shaft being provided with a scale on its periphery for indicating the fluid content therein when is used separately as a weight lifting device.

5. The device set forth in claim 4 wherein:

said hollow containers are transparent configurations axially mounted on the ends of said shafts.

6. The device set forth in claim 1 wherein:

said containers are generally spherical in shape.

7. The device set forth in claim 1 wherein:

said platform means is positioned between the containers on each shafts and interlocking releasably said shafts for providing a raft for use on the water.

* * * * *

UNITED STATES PATENT OFFICE

CERTIFICATE OF CORRECTION

Patent No. 4,089,528 Dated May 16, 1978

Inventor(s) William L. Green

It is certified that error appears in the above-identified patent and that said Letters Patent are hereby corrected as shown below:

Claim 7, line 3, after "each" cancel "shafts" and substitute ---shaft---.

Claim 7, line 3, after "interlocking" cancel "releasably" and insert ---releasably--- after "and".

Signed and Sealed this

*Tenth* Day of *October 1978*

[SEAL]

*Attest:*

RUTH C. MASON
*Attesting Officer*

DONALD W. BANNER
*Commissioner of Patents and Trademarks*